US010687590B2

(12) United States Patent
Lin

(10) Patent No.: US 10,687,590 B2
(45) Date of Patent: Jun. 23, 2020

(54) LOCKING HOOK MEMBER AND ZIPPER HEAD ASSEMBLY STRUCTURE

(71) Applicant: WEIFANG ZHONG CHUAN ZIP FASTENER ACCESSORY CO., LTD., Weifang, Shandong Prov (CN)

(72) Inventor: Yu-Pau Lin, Taoyuan (TW)

(73) Assignee: WEIFANG ZHONG CHUAN ZIP FASTENER ACCESSORY CO., LTD., Weifang, Shandong Province (CN)

( * ) Notice: Subject to any disclaimer, the term of this patent is extended or adjusted under 35 U.S.C. 154(b) by 0 days.

(21) Appl. No.: 16/351,483

(22) Filed: Mar. 12, 2019

(65) Prior Publication Data

US 2020/0000182 A1 Jan. 2, 2020

(30) Foreign Application Priority Data

Jun. 27, 2018 (TW) ..... 107122113 A

(51) Int. Cl.
*A44B 19/30* (2006.01)

(52) U.S. Cl.
CPC ..... *A44B 19/308* (2013.01)

(58) Field of Classification Search
CPC ..... A44B 19/308; A44B 19/26; A44B 19/262
See application file for complete search history.

(56) References Cited

U.S. PATENT DOCUMENTS 3,924,306 A * 12/1975 Oda ..... A44B 19/308 24/424
4,123,828 A * 11/1978 Akashi ..... A44B 19/308 24/422
4,667,376 A * 5/1987 Ishii ..... A44B 19/308 24/421
4,679,281 A * 7/1987 Ishii ..... A44B 19/308 24/419
4,982,479 A * 1/1991 Oda ..... A44B 19/26 24/424
5,167,052 A * 12/1992 Aoki ..... A44B 19/301 24/421
5,544,394 A * 8/1996 Yaguramaki ..... A44B 19/308 24/424

(Continued)

FOREIGN PATENT DOCUMENTS

CN 2502547 Y 7/2002
CN 202588551 U 12/2012
TW 201632104 A 9/2016

*Primary Examiner* — Robert Sandy
*Assistant Examiner* — Louis A Mercado
(74) *Attorney, Agent, or Firm* — Li & Cai Intellectual Property Office

(57) ABSTRACT

A zipper head assembly structure including a zipper head element and a puller is provided. The zipper head includes a zipper head body, a cap body disposed on the zipper head body, and a hook disposed inside the cap body. The cap body includes two curved surfaces opposite to each other. The hook includes a holding part, a hooking part, and a connecting element connecting the holding part and the hooking part. The connecting element includes a protruding block near the holding part. The puller includes a through opening hooked by the locking hook member. The width of the through opening is smaller than the distance between the protruding block and the adjacent curved surface.

6 Claims, 11 Drawing Sheets

(56) References Cited

U.S. PATENT DOCUMENTS

| | | | | | |
|---|---|---|---|---|---|
| 5,611,121 | A * | 3/1997 | Akeno | A44B 19/308 | 24/423 |
| 5,625,928 | A * | 5/1997 | Terada | A44B 19/308 | 24/424 |
| 5,628,094 | A * | 5/1997 | Mizuno | A44B 19/305 | 24/423 |
| 5,809,622 | A * | 9/1998 | Yaguramaki | A44B 19/308 | 24/421 |
| 5,848,455 | A * | 12/1998 | Ikehara | A44B 19/306 | 24/422 |
| 5,864,928 | A * | 2/1999 | Matsushima | A44B 19/26 | 24/421 |
| 5,956,819 | A * | 9/1999 | Terasaki | A44B 19/26 | 24/432 |
| 2019/0223560 | A1* | 7/2019 | Lin | A44B 19/26 | |

* cited by examiner

LOCKING HOOK MEMBER AND ZIPPER HEAD ASSEMBLY STRUCTURE

This application claims the benefit of priority to Taiwan Patent Application No. 107122113, filed on Jun. 27, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a hook member, and more particularly to a hook member adapted for a zipper head assembly structure and a zipper head assembly structure using the hook member.

BACKGROUND OF THE DISCLOSURE

The zipper is a commonly used item in everyday life, and usually includes a zipper head and two zipper straps. When the zipper head moves back and forth on the zipper tapes, the zipper tapes can be loosened or engaged with each other. Owing to their simple structure and easy operation, zippers have been widely applied in clothing, backpacks, purses, suitcases and other objects.

Referring to FIGS. 1 and 2, a conventional zipper head 9 includes a slider 91, a puller 92, a locking hook member 93, a cap body 94, and an elastic piece 95. The locking hook member 93 is movably disposed in the recessed space above the slider 91, wherein a hook opening 931 hooks a through opening 921 of the puller 92, and is covered by the cap body 94 and fixed to the slider 91. The elastic piece 95 is disposed between the cap body 94 and the locking hook member 93, and constantly provides a resilient biasing force that drives the locking hook member 93 to yaw away from the cap body 94.

The puller 92 is capable of swinging within a space 96 defined together by the slider 91 and the cap body 94. When the puller 92 is laterally deflected, both sides of the through opening 921 can easily be stuck between the cap 94 and the slider 91 to make movement difficult. Therefore, when the zipper head is applied with an electroplating process, since the puller 92 is stuck on the cap 94 and the slider 91, it would be difficult to form a plating layer at the bonding area, which becomes a dead angle for the electroplating process, so that there is a need for improvement in the related art.

SUMMARY OF THE DISCLOSURE

In response to the above-referenced technical inadequacies, the present disclosure provides a locking hook member and a zipper head assembly structure adapted for the zipper head assembly structure.

In one aspect, the present disclosure provides a locking hook member adapted for a zipper head assembly structure, which includes a holding part, a hooking part, and a connecting element. The connecting element connects the holding part and the hooking part, and includes a protruding block adjacent to the holding part.

In one aspect, the present disclosure provides another zipper head assembly structure including a zipper head assembly and a puller. The zipper head assembly includes a zipper head body, a cap body disposed on the zipper head body, and a locking hook member disposed in the cap body. The cap body includes two curved surfaces at two opposite sides thereof; the locking hook member includes a holding part, a hooking part, and a connecting element connecting the holding part and the hooking part. The connecting element includes a protruding block adjacent to the holding part. The puller includes a through opening that is hooked by the locking hook member. The width of the through opening is smaller than the distance between the protruding block and the adjacent curved surface.

In one aspect, the present disclosure provides yet another zipper head assembly structure including a zipper head assembly and a puller. The zipper head assembly includes a zipper head body, a cap body disposed on the zipper head body, and a locking hook member disposed in the cap body. The cap body includes two curved surfaces on opposite sides of the cap body. The locking hook member includes a hook opening and a protruding block formed on the hook opening. The puller includes a curved rod hooked to the hook opening. The curved rod includes two side rod segments spaced apart from each other. When one of the side rod segments of the puller abuts against the protruding block of the locking hook member, the other side rod segment is limited within a range between the curved surfaces.

Therefore, one of the beneficial effects of the present disclosure is that in order to prevent the puller from moving and nearing the holding part, the movement range of the puller movement is restricted to prevent the puller from being stuck on the zipper head assembly by placing a protruding block adjacent to the holding part on the locking hook member.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
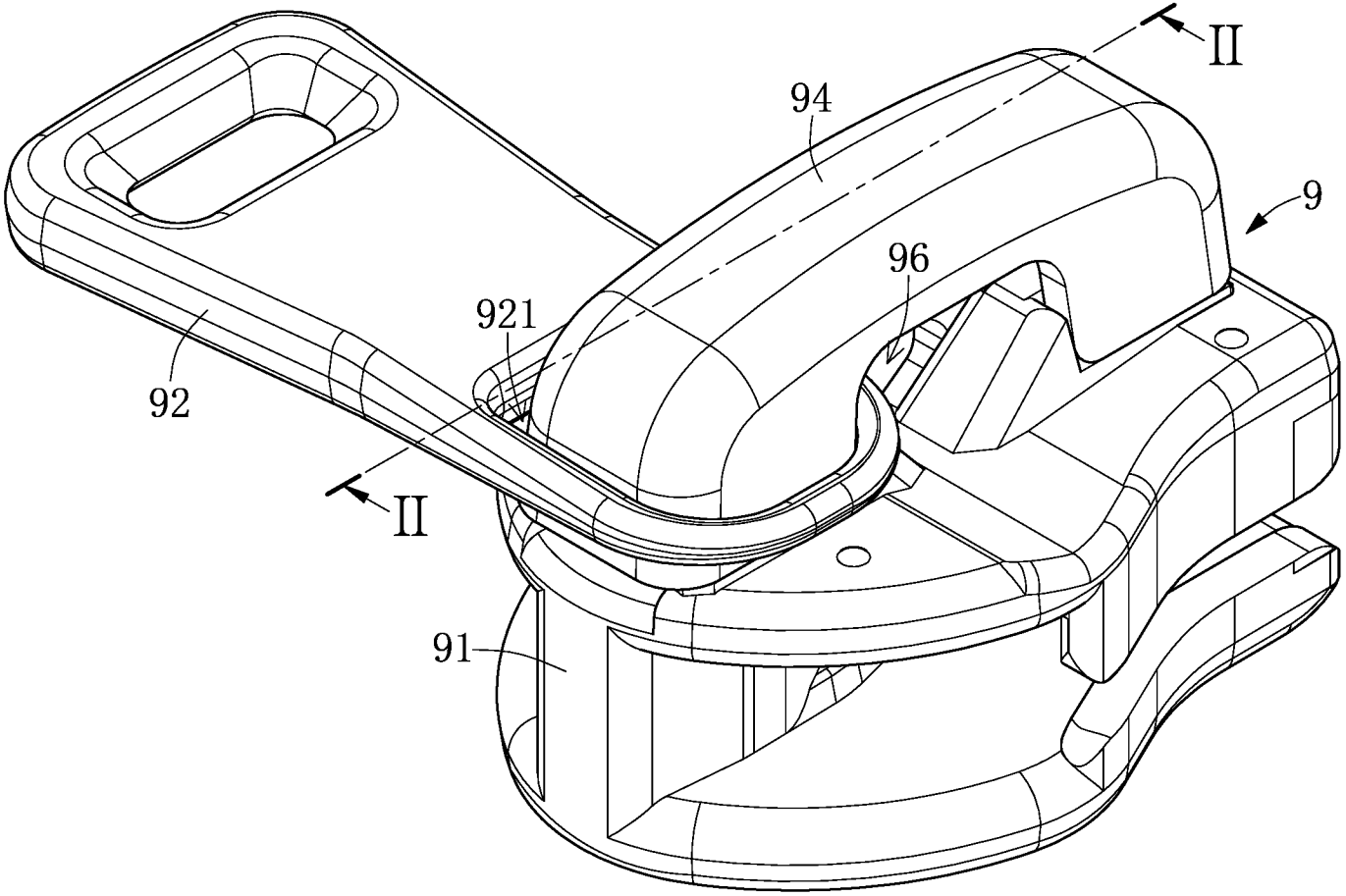
FIG. 1 RELATED ART
FIG. 1 is a perspective view showing a conventional zipper head assembly structure.
Figure 2:
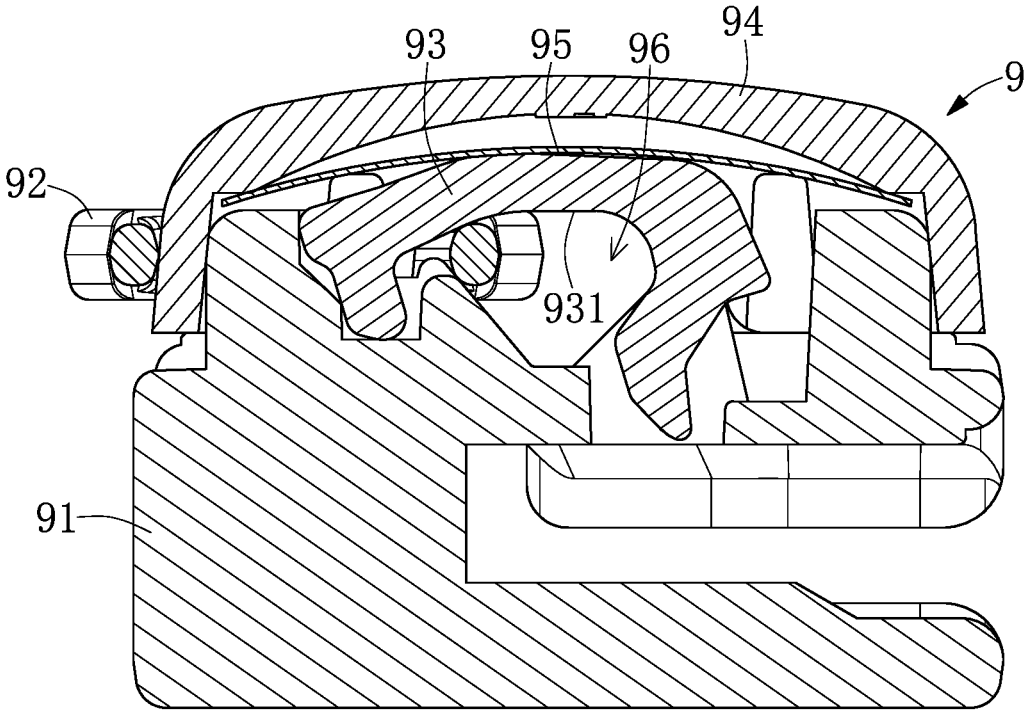
FIG. 2 RELATED ART
FIG. 2 is a cross-segmental view, taken along line II-II of FIG. 1, showing a conventional zipper head assembly structure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 3:
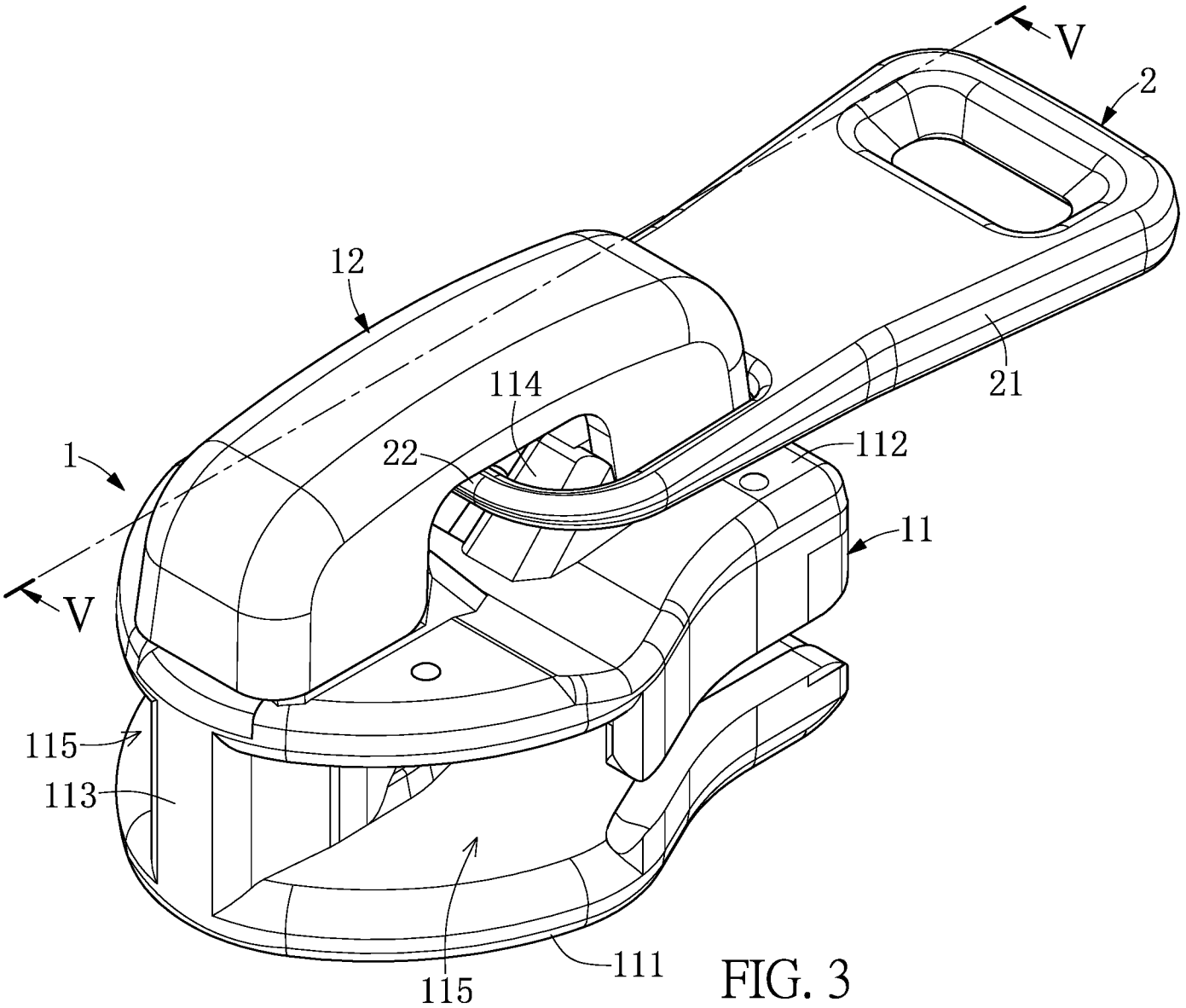
FIG. 3 is a perspective view showing the zipper head assembly structure of an embodiment of the present disclosure.
Figure 4:
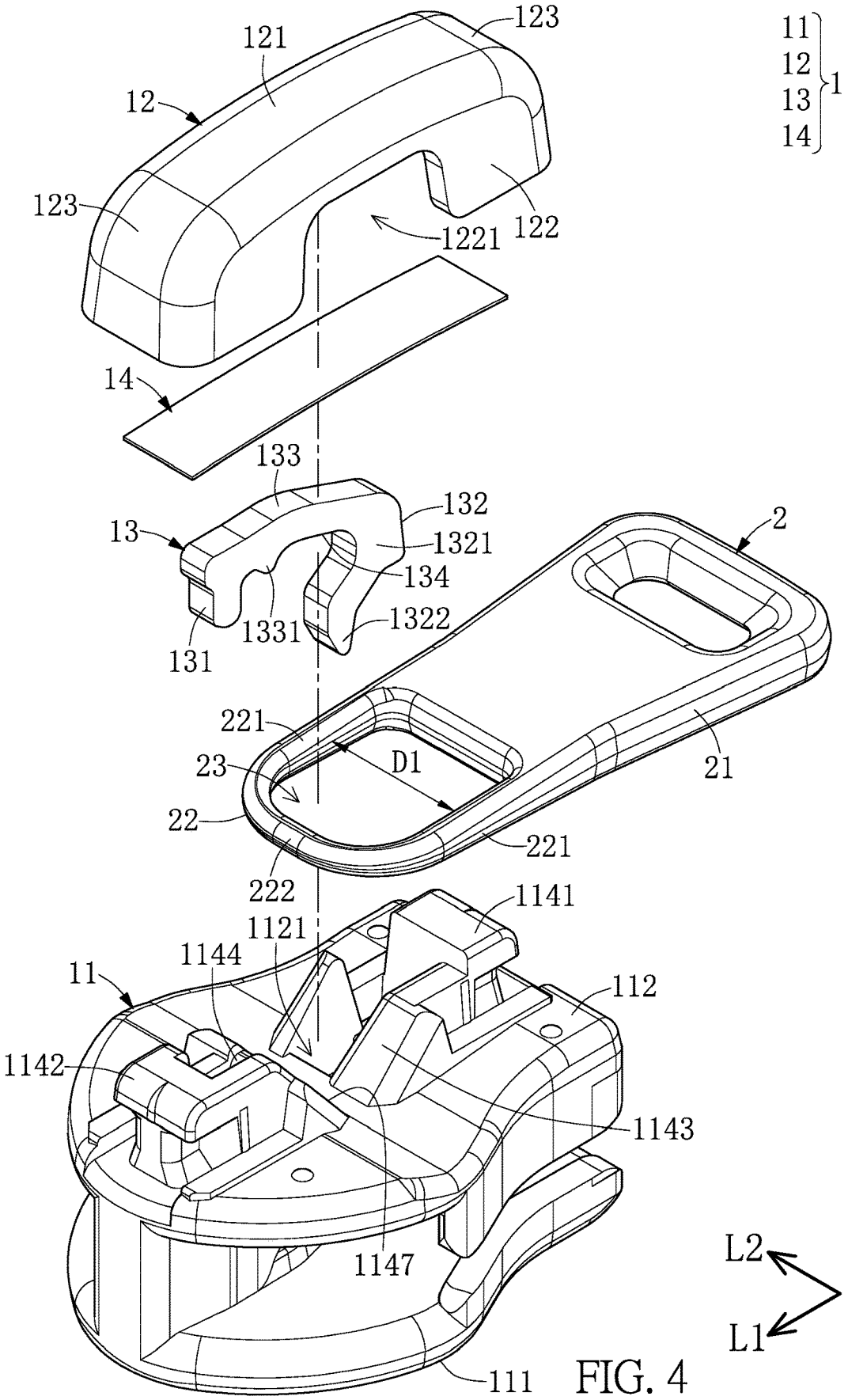
FIG. 4 is an exploded perspective view of an embodiment of the present disclosure.
Figure 5:
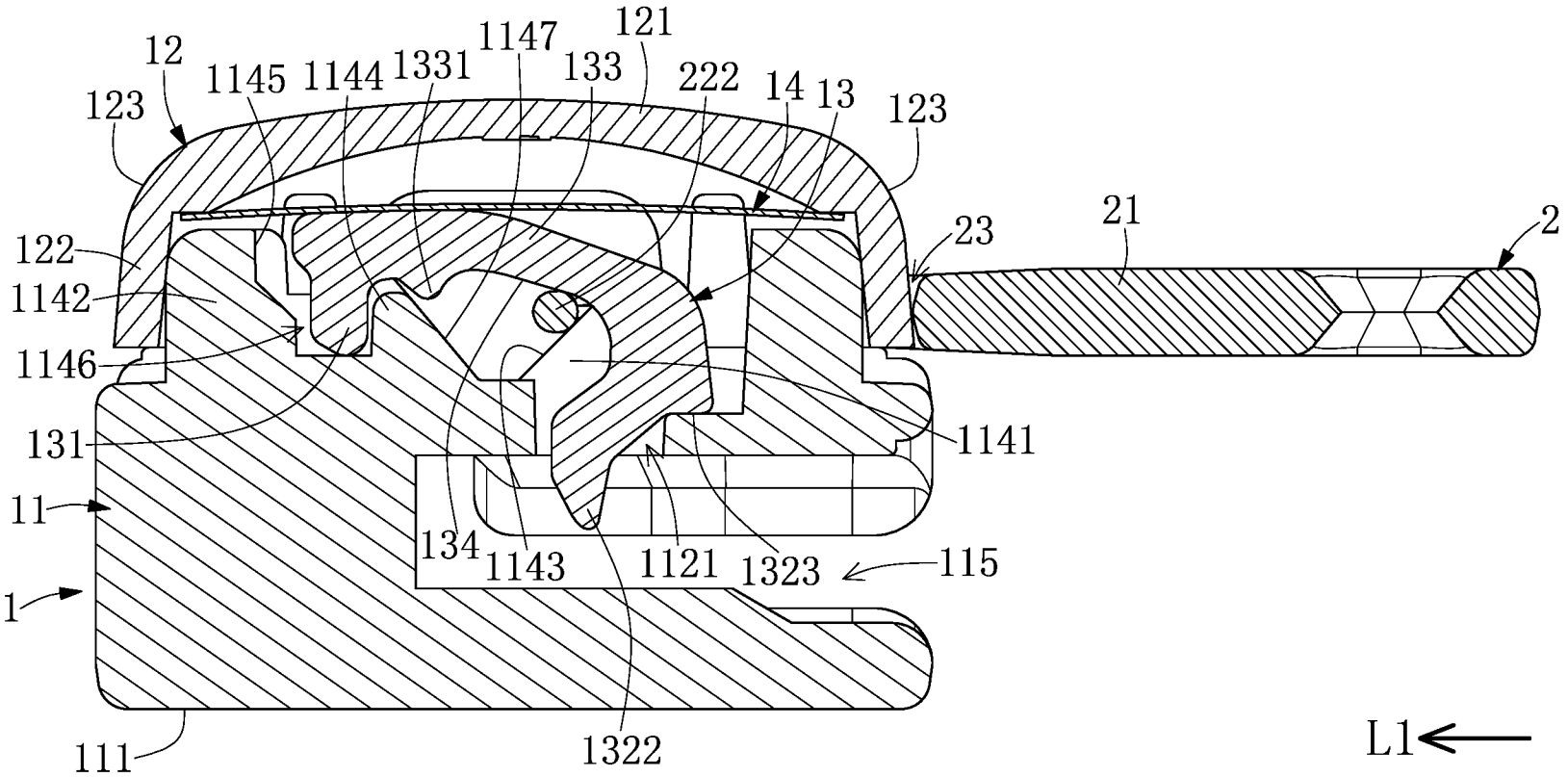
FIG. 5 is a cross-segmental view taken along line V-V of FIG. 3, showing an embodiment.
Figure 6:
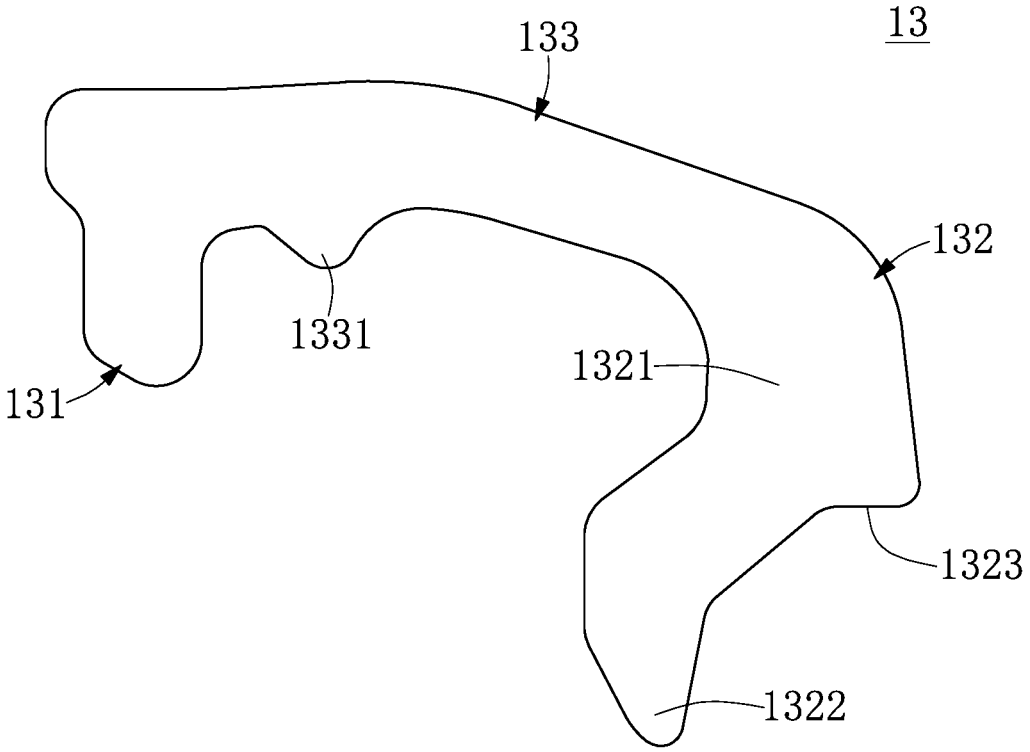
FIG. 6 is a side view showing the locking hook member of the embodiment of the present disclosure.
Figure 7:
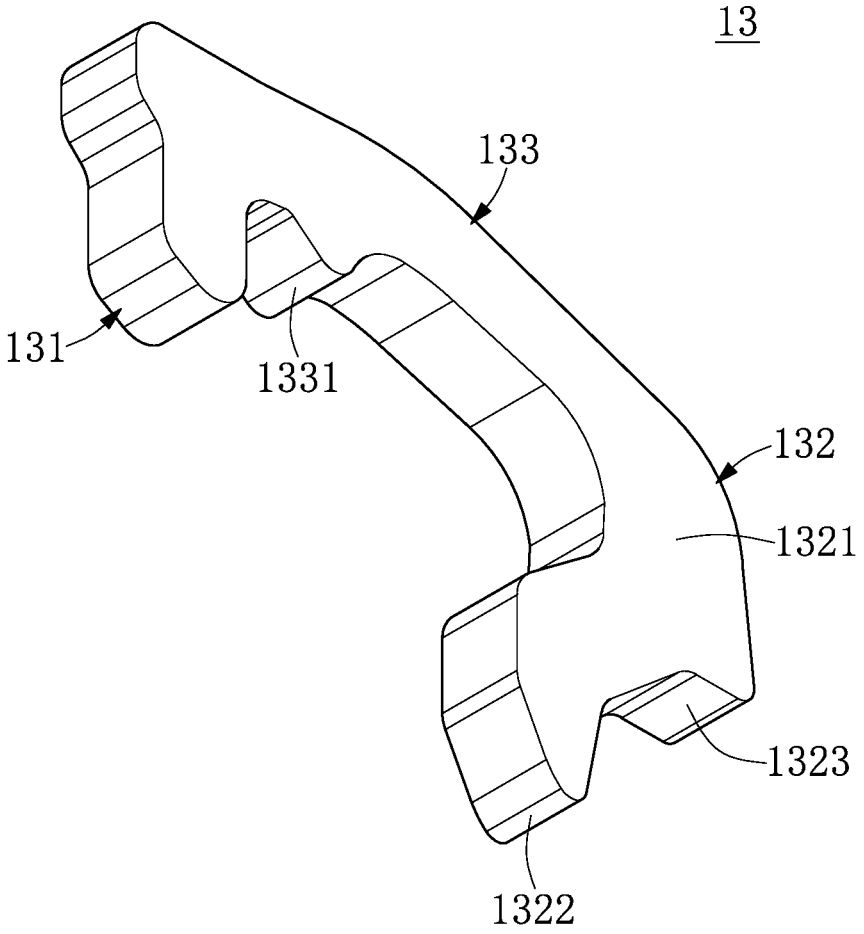
FIG. 7 is a bottom view showing the locking hook member of the embodiment of the present disclosure.

Referring to FIG. 3 to FIG. 5, an embodiment of the present disclosure provides a zipper head assembly structure including: a zipper head assembly 1 and a puller 2.

The zipper head assembly 1 includes a zipper head body 11, a cap body 12, a locking hook member 13, and an elastic piece 14. The zipper head body 11 includes a lower wall 111, an upper wall 112 spaced apart from the lower wall 111, a connection wall 113 connecting the lower wall 111 and the upper wall 112, and a mount 114 disposed on the upper wall 112. Two thoroughfares 115 for the zipper tape (not shown) are defined together by the lower wall 111, the upper wall 112, and the connection wall 113. The upper wall 112 includes a through hole 1121. The mount 114 includes a first support body 1141 and a second support body 1142. The first support body 1141 is disposed around the through hole 1121 and includes a first slope 1143. The second support body 1142 includes a guiding block 1144, a limiting surface 1145 spaced apart from the guiding block 1144, and a hook groove 1146 which is arranged between the guiding block 1144 and the limiting surface 1145. The guiding block 1144 includes a second slope 1147 opposite to the first slope 1143.

The cap body 12 is placed on the zipper head body 11 and covers the mount 114. The cap body 12 extends in a longitudinal direction L1 and includes a top wall 121, a surrounding wall 122 surrounding the top wall 121, and two curved corners 123. The curved corners 123 are located at the boundary between the top wall 121 and the surrounding wall 122, and are spaced apart from the opposite sides of the top wall 121 along the longitudinal direction L1. The surrounding wall 122 surrounds the mount 114 disposed on the zipper head body 11 and includes a horizontal opening 1221 extending in a lateral direction L2. The lateral direction L2 is substantially perpendicular to the longitudinal direction L1. The position of the horizontal opening 1221 corresponds to that of the space between the first slope 1143 and the second slope 1147.

Referring to FIGS. 4 to 6 and FIG. 7, the locking hook member 13 is movably disposed on the zipper head body 11. The locking hook member 13 is in the form of a sheet and includes a holding part 131, a hooking part 132, and a connecting element 133 connecting the holding part 131 and the hooking part 132. The holding part 131 is of an elongated shape and is swingably disposed in the hook groove 1146 of the second support body 1142. The hooking part 132 is located in the first support body 1141 and includes a curved segment 1321 and a positioning end 1322. The curved segment 1321 includes an abutting surface 1323 that can abut against the upper wall 112 of the zipper head body 11. The positioning end 1322 is gradually tapered in an outward direction from the curved segment 1321, and passes through the through hole 1121 and into the thoroughfare 115 to contact the zipper tape. The connecting element 133 is substantially in the shape of an arc and defines a hook opening 134 in conjunction with the hooking part 132. The connecting element 133 includes a protruding block 1331 formed in the hook opening 134 and adjacent to the holding part 131. Preferably, the shortest distance from the protruding block 1331 to the curved segment 1321 is greater than the shortest distance from the protruding block 1331 to the holding part 131. The protruding block 1331 is adjacent to the guiding block 1144 of the second support body 1142, and the guiding block 1144 is located between the protruding block 1331 and the holding part 131. The shape of the protruding block 1331 may be a triangle, a rectangle, a semicircle, an ellipse or the like, but is not limited thereto. In the present embodiment, a triangle is taken as an example.

The elastic piece 14 is disposed between the cap body 12 and the locking hook member 13 and is attached to the connecting element 133 of the locking hook member 13. The elastic piece 14 constantly provides a resilient biasing force that drives the positioning end 1322 of the locking hook member 13 deep into the thoroughfare 115. The shape and material of the elastic piece 14 are not limited and are known to those skilled in the art, and therefore will not be described herein.

The puller 2 includes a pulling part 21 and a curved rod 22. The pulling part 21 is adapted to allow the user to pull and operate with a finger. The curved rod 22 is generally U-shaped, and both ends are connected to the pulling part 21, and hooked to the hook opening 134 of the locking hook member 13. The curved rod 22 defines a through opening 23 that is hooked by the locking hook member 13, and includes two side rod segments 221 that are spaced apart from each other and a pulling rod segment 222 that connects with the side rod segment 221. The distance between the side rod segments 221 is the width of the through opening 23, and the distance from the pulling rod segment 222 to the pulling part 21 is the length of the through opening 23.

In this embodiment, the curved shape of the curved rod 22 is substantially U-shaped, and defines a substantially rectangular through opening 23 together with the pulling part 21, but the shape of the curved rod 22 is not limited to being U-shaped, and may also be rectangular or elliptical, circular, or the like. Similarly, since the curved rod 22 defines the shape of the through opening 23, the shape of the through opening 23 may be a rectangle, an ellipse, a circle or the like.

The user can operate the puller 2 so that the pulling rod segment 222 of the curved rod 22 drives the zipper head assembly structure to move so as to determine whether the zipper strips are loosened or engaged with each other. When the puller 2 is pulled in the direction of the first support body 1141, the pulling rod segment 222 of the curved rod 22 will abut against the first slope 1143 and drive the zipper head assembly 1 to move. Similarly, when the puller 2 is pulled in the direction of the second support body 1142, the pulling rod segment 222 will abut against the second slope 1147 and drive the zipper head assembly 1 to move, thereby controlling the occlusion of the zipper belts. That is to say, under normal circumstances, the first slope 1143 and the second slope 1147 are pushed by the pulling rod segment 222 of the puller 2 to control the movement of the zipper head assembly 1, and the curved rod 22 of the puller 2 can swing freely within the range between the first slope 1143 and the second slope 1147.

Figure 8:
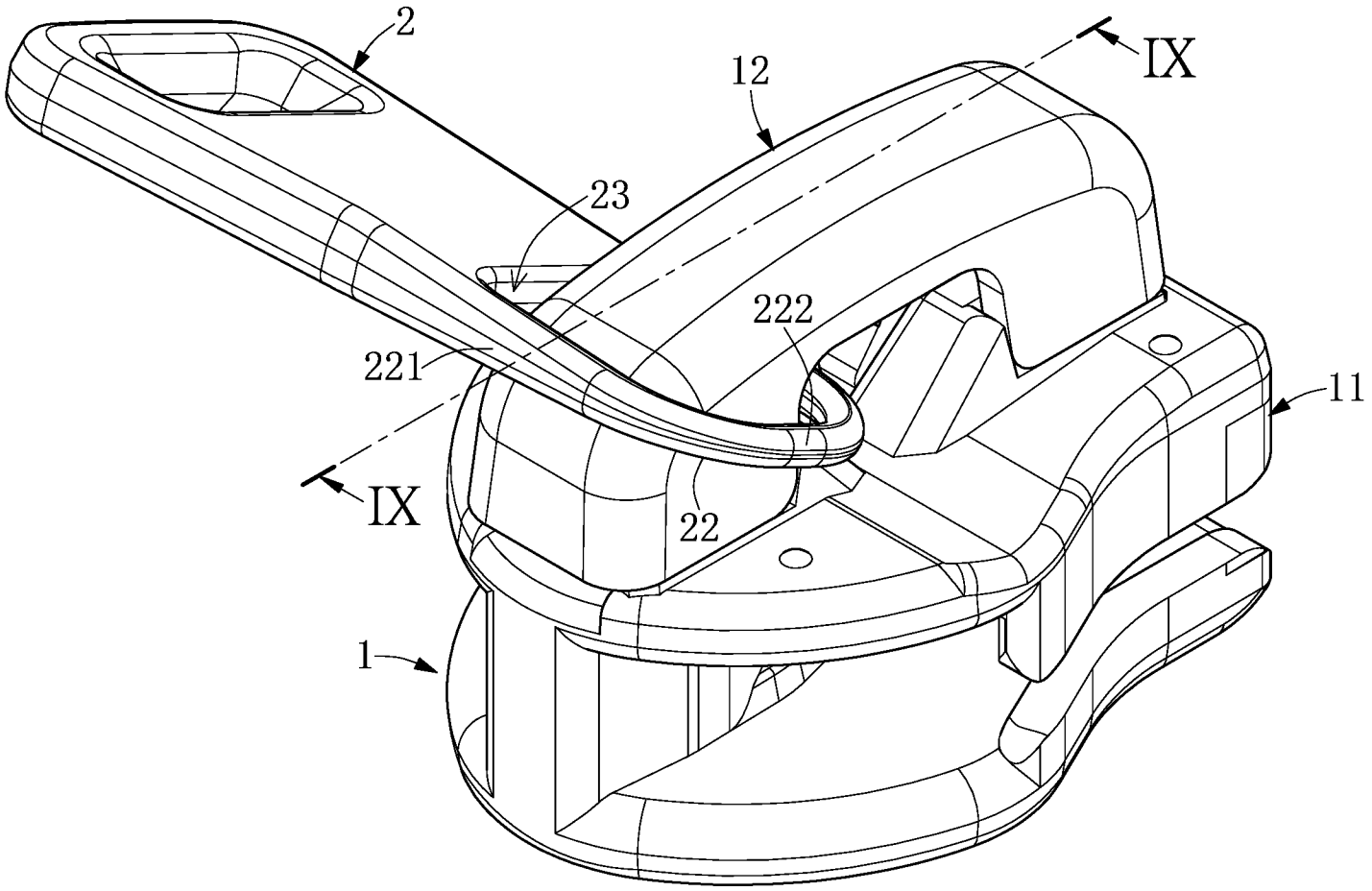
FIG. 8 is a perspective view showing the puller of the embodiment being limited on the top side of the cap body.
Figure 9:
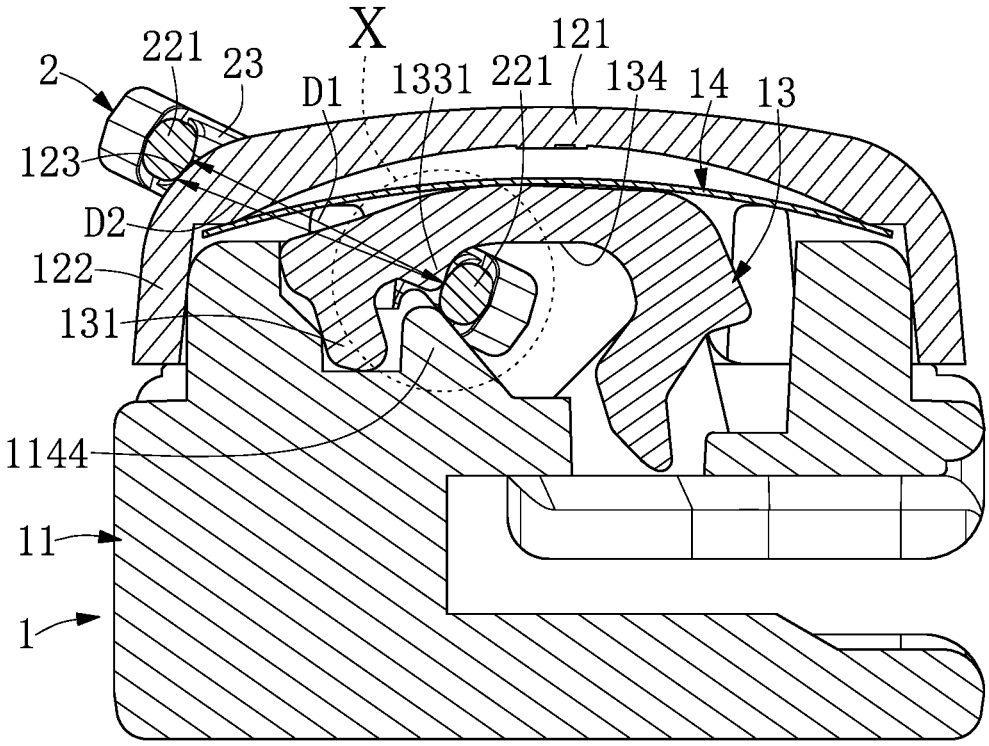
FIG. 9 is a cross-segmental view taken along the line IX-IX of FIG. 8, showing the puller of the embodiment being limited on the top side of the cap body.

In the aforementioned operation, since the length of the through opening 23 of the puller 2 is greater than the minimum distance between the second slope 1147 of the second support body 1142 and the surrounding wall 122 of the cap body 12, the puller 2 is prevented from being stuck on the zipper head body 11. However, since the width of the through opening 23 of the puller 2 is usually approximately equal to the minimum distance between the second slope 1147 and the surrounding wall 122, when the puller 2 is turned sideways, the through opening 23 may be stuck on the second slope 1147 and the surrounding wall 122. Referring to FIGS. 8 and 9, the present disclosure limits the range of movement of the puller 2 by forming a protruding block 1331 on the locking hook member 13 to prevent the puller 2 from being stuck on the zipper head assembly 1. In detail, by forming a protruding block 1331 on the locking hook member 13, a blocking point is formed. When the width D1 of the through opening 23 of the puller 2 is smaller than the distance D2 between the protruding block 1331 and the adjacent curved surface 123, the puller 2 does not get stuck on the second slope 1147 and the surrounding wall 122. That is, when one side of the through opening 23 is leaning against the protruding block 1331, the other side cannot reach the surrounding wall 122 by crossing over the curved surface 123 due to its small width, thereby preventing the through opening 23 of the puller 2 from being stuck on the zipper head assembly 1 and being unable to move.

In other words, by disposing the protruding block 1331 on the locking hook member 13, the range of movement of the puller 2 is limited. When one of the side rod segments 221 of the puller 2 abuts against the protruding block 1331, the other side rod segment 221 is limited within the range of angle between the curved surfaces 123. That is, the other side rod segment 221 can only swing within the range above the top wall 121 and cannot move to the surrounding wall 122. That is to say, the arrangement of the protruding block 1331 can block the movement of the side rod segment 221, so that the distance between the side rod segments 221 is insufficient for the side rod segment 221 to cross over the curved surface 123, so that the side rod segment 221 can only move within the range between the curved surfaces 123, and is not easily stuck on the second slope 1147 and the surrounding wall 122.

Figure 10:
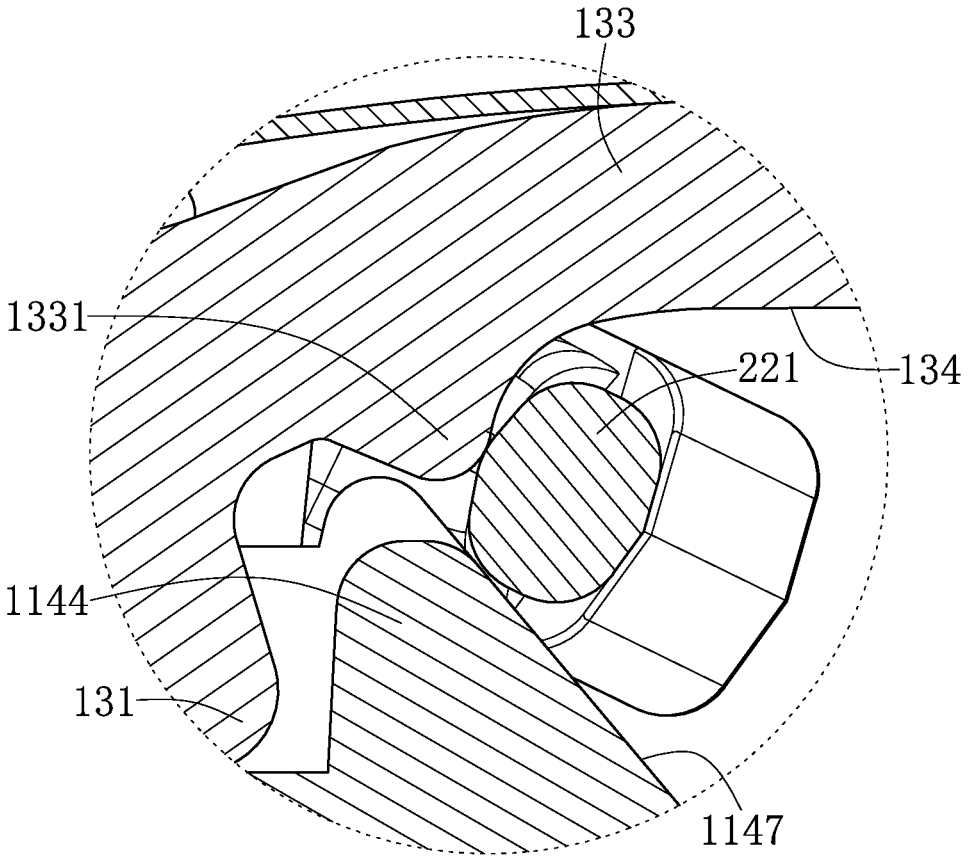
FIG. 10 is an enlarged schematic view showing a portion X of FIG. 9.
Figure 11:
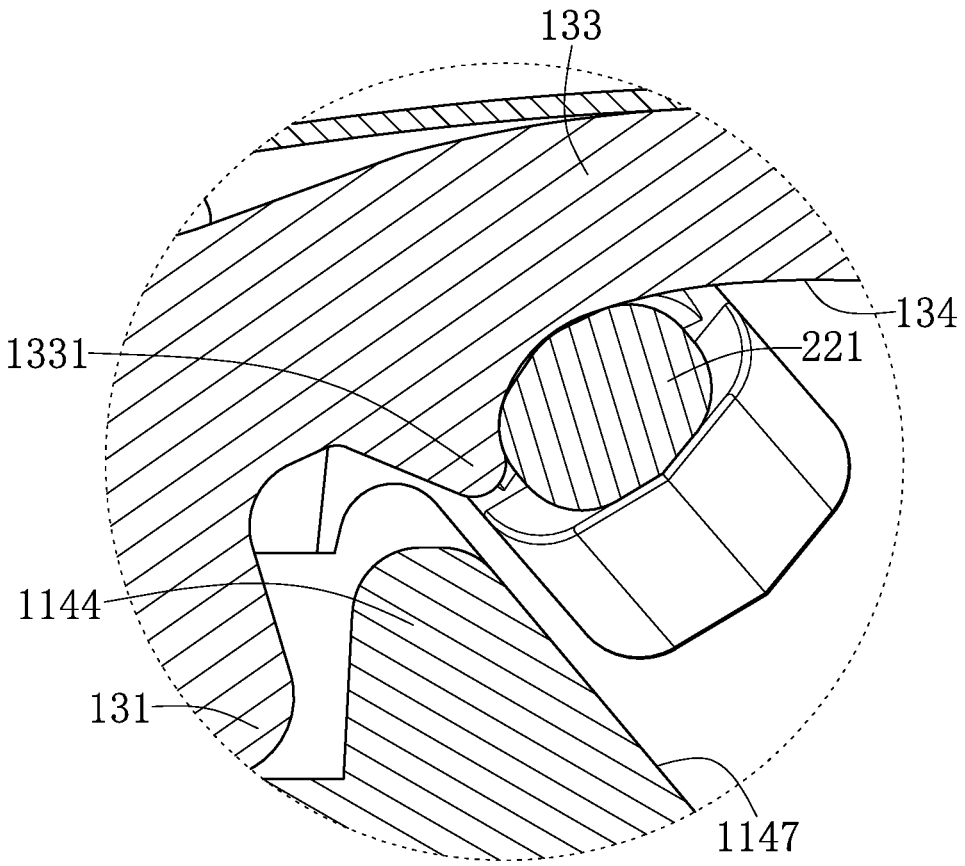
FIG. 11 is a schematic view similar to FIG. 10 showing another change pattern of the embodiment.

Referring to FIG. 10, it should be noted that the side rod segment 221 simultaneously abut against the protruding block 1331 and the second slope 1147, but can also be pushed by the protruding block 1331 without being adjacent to the second slope 1147. Referring to FIG. 11, in another configuration of the embodiment, the end of the locking block 1331 of the locking hook member 13 extends away from the connecting element 133, so that the side rod segment 221 only abuts against the protruding block 1331 but does not abut against the second slope 1147. This structure also prevents the puller 2 from being stuck on the zipper head assembly 1.

It should be noted that although the shape of the curved rod 22 can be varied, whether being a rectangle, an ellipse, a circle or the like, as long as the maximum value of the width D1 of the curved rod 22 is smaller than the minimum value of the distance D2 between the protruding block 1331 and the adjacent curved surface 123, the curved rod 22 can be prevented from being stuck on the zipper head assembly 1.

In addition, when the locking hook member 13 swings, a gap is formed between the protruding block 1331 and the guiding block 1144, and the minimum outer diameter of the curved rod 22 is greater than the aforementioned gap, so that when the puller 2 is operated, the curved rod 22 is not embedded between the protruding block 1331 and the guiding block 1144, resulting in an unsmooth operation.

In this way, by virtue of the protruding block 1331 disposed on the locking hook member 13, the probability of the puller 2 being stuck on the zipper head assembly 1 after the lateral deflection can be reduced without changing the structure of the puller 2, the dead angle in the electroplating process can avoided, and the yield of the zipper head can be improved.

Through the above description, the advantages of this embodiment can be summarized as follows:

1. By virtue of the protruding block 1331 disposed adjacent to the holding part 131 on the locking hook member 13, the puller 2 of the zipper head is prevented from moving and is close to the holding part 131, thereby limiting the range of movement of the puller 2 to prevent the puller 2 from being stuck on the zipper head assembly 1.

2. By virtue of the protruding block 1331 disposed on the locking hook member 13, the distance D2 between the protruding block 1331 and the adjacent curved surface 123 is greater than the through opening 23 width D1 of the puller 2, so that when one side of the through opening 23 abuts against the protruding block 1331, the other side cannot reach the surrounding wall 122 across the curved surface 123, thus avoiding being stuck on the zipper head assembly 1.

3. By providing the protruding block 1331, the movement of the side rod segment 221 can be blocked. When one of the rods of the puller 2 abuts against the protruding block 1331, the other side rod segment 221 is limited within the range between the curved surfaces 123, preventing the puller 2 from being stuck on the zipper head assembly 1.

4. The gap between the protruding block 1331 and the guiding block 1144 is smaller than the outer diameter of the curved rod 22, so as to prevent the curved rod 22 from being stuck between the protruding block 1331 and the guiding block 1144, and being stuck in the zipper head assembly 1, resulting in an unsmooth operation.

In conclusion, the puller 2 can be prevented from being stuck on the zipper head assembly 1 by the protruding block 1331 formed on the locking hook member 13. Thus, the aim of the present disclosure can be achieved.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A zipper head assembly structure, comprising:

a zipper head assembly including a zipper head body, a cap body disposed on the zipper head body, and a locking hook member disposed in the cap body; wherein the cap body includes two curved surfaces on opposite sides of the cap body, the locking hook member includes a holding part, a hooking part and a connecting element connecting the holding part and the hooking part, and the connecting element includes a protruding block adjacent to the holding part; and a puller including a through opening hooked by the locking hook member, and a width of the through opening is smaller than a distance between the protruding block and the adjacent curved surface;

wherein the puller further includes a curved rod defining the through opening, the curved rod includes two side rod portions spaced apart from each other, and a distance between the side rod portions is a width of the through opening;

wherein when one of the side rod portions of the puller abuts against the protruding block of the locking hook member, the other side rod is limited within a range between the curved surfaces.

2. The zipper head assembly structure according to claim 1, wherein the zipper head body includes a mount movably disposed for the locking hook member, the mount includes a guiding block adjacent to the protruding block of the locking hook member; wherein the puller further includes a curved rod defining the through opening, a minimum outer diameter of the curved rod being greater than a gap between the guiding block and the protruding block; wherein the mount of the zipper head body further includes a limiting surface spaced apart from the guiding block, the holding part of the locking hook member swinging between the guiding block and the limiting surface.

3. The zipper head assembly structure according to claim 1, wherein the hooking part of the locking hook member includes a curved segment and a shortest distance from the protruding block to the curved segment is greater than a shortest distance from the protruding block to the holding part.

4. A zipper head assembly structure, comprising:

a zipper head assembly including a zipper head body, a cap body disposed on the zipper head body, and a locking hook member disposed in the cap body; wherein the cap body includes two curved surfaces on opposite sides of the cap body, the locking hook member includes a hook opening and a protruding block formed on the hook opening; and a puller including a curved rod hooked to the hook opening, the curved rod including two side rod segments spaced apart from each other;

wherein when one of the side rod segments of the puller abuts against the protruding block of the locking hook member, the other side rod segment is limited within a range between the curved surfaces.

5. The zipper head assembly structure of claim 4, wherein the locking hook member further includes a holding part and a hooking part spaced apart from each other, wherein the hooking part includes a curved segment, and a shortest distance from the protruding block to the curved segment is greater than a shortest distance from the protruding block to the holding part.

6. The zipper head assembly structure of claim 5, wherein the zipper head body includes a mount movably disposed for the locking hook member, wherein the mount includes a guiding block adjacent to the protruding block of the locking hook member; a minimum outer diameter of the curved rod of the puller is greater than a gap between the guiding block and the protruding block, and wherein the mount of the zipper head body further includes a limiting surface spaced apart from the guiding block, and the holding part of the locking hook member swings between the guiding block and the limiting surface.

* * * * *